US005984775A

United States Patent [19]

Lee et al.

[11] Patent Number: 5,984,775

[45] Date of Patent: Nov. 16, 1999

[54] GRATING AND SHUTTER APPARATUS FOR CONTROLLING AIR FLOW

[75] Inventors: Kun-hyung Lee, Sungnam; Tae-jin Hwang, Yongin, both of Rep. of Korea

[73] Assignee: Samsung Electronics Co., Ltd., Suwon, Rep. of Korea

[21] Appl. No.: 08/953,380

[22] Filed: Oct. 17, 1997

[30] Foreign Application Priority Data

Oct. 28, 1996 [KR] Rep. of Korea ..... 96-49285

[51] Int. Cl.[6] ..... F24F 13/12

[52] U.S. Cl. ..... 454/187; 454/186; 454/358

[58] Field of Search ..... 454/185, 186, 454/187, 298, 339, 358

[56] References Cited

U.S. PATENT DOCUMENTS 3,314,353 4/1967 Knab ..... 454/187

5,218,998 6/1993 Bakken et al. ..... 454/298 X

FOREIGN PATENT DOCUMENTS 63-204049 8/1988 Japan ..... 454/187

*Primary Examiner*—Harold Joyce

*Attorney, Agent, or Firm*—Jones Volentine, L.L.P.

[57] ABSTRACT

An apparatus for controlling air flow includes a grating having a plurality of air vents, a shutter assembly composed of a shutter fixed plate, having a plurality of first openings, attached to a lower surface of the grating, and a shutter moving plate, having a plurality of second openings corresponding to the first openings, movably disposed between the grating and the fixed plate. An opening-ratio controller moves the moving plate with respect to the fixed plate whereby an opening ratio defined by relative positions of the first openings and the second openings is controlled. The separation between the grating and the shutter fixed plate may be the thickness of the shutter moving plate. The opening-ratio controller may include an opening-ratio controlling screw having a pinion attached to the screw end.

8 Claims, 4 Drawing Sheets

GRATING AND SHUTTER APPARATUS FOR CONTROLLING AIR FLOW

BACKGROUND OF THE INVENTION

1. Field of the Invention

The present invention relates to an apparatus for controlling air flow in semiconductor clean rooms for manufacturing semiconductor devices and, more particularly, to an apparatus with a shutter attached to the lower surface of a grating installed in the floor of a semiconductor clean room.

2. Description of the Related Art

Semiconductor device production, which is performed in a highly purified, precise and sterile environment, has been made possible by advances in many types of technologies, including cleaning technologies. Cleaning technologies are especially important for improving the quality and efficiency of semiconductor devices.

Cleaning technologies primarily rely on clean rooms to provide a particle-free environment for the production process. Clean rooms are widely used not only in the electronics industries, but also in other industries such as precision instrument manufacturing, chemical production, hospital operations, and food preparation.

The clean rooms used in the semiconductor manufacturing industries are spaces in which the number of particles floating in the air is controlled to be below a predetermined value so that such particles do not contaminate a workpiece. In addition, the temperature, humidity, inner pressure, intensity of illumination, noise, vibration, etc. are also controlled together in clean rooms. To control the number of the particles in the room, clean air is continuously fed into the clean room and waste air is continuously removed through a circulation line. In the circulation line the polluted air removed from the clean room is passed through a filter installed on the inlet of the clean room. In this process, the cleaning may be enhanced by adding a scrubber to the circulation line.

An adequate air flow needs to be maintained to keep the number of particles below the predetermined levels. The proper air flow depends on the capacities of the various filters or cleaning devices installed in the circulating lines, the volume capacity of any pumps, and the volume of the clean room. To control an air flow in the clean room, a grating with a lattice of vents is usually installed in the floor of the clean room and a shutter is attached under the grating.

FIG. 1 is a side view of a conventional apparatus for controlling air flow in semiconductor clean rooms. FIG. 2 is an exploded view of the air flow controlling apparatus of FIG. 1.

As illustrated in FIG. 1 and FIG. 2, the conventional air flow controlling apparatus is composed of a grating 10 and a shutter assembly attached to the lower surface of the grating 10. The shutter has a shutter fixed plate 26, and a shutter moving plate 18 disposed between the grating 10 and the shutter fixed plate 26, so that the moving plate 18 can be moved from side to side as shown by the arrow in FIG. 2.

The grating 10 is made of a plastic or ceramic material having a box shape with a square or rectangular top surface. A plurality of air vents 12 are formed in the grating in a matrix, i.e. arranged in rows and columns. Also, a grating through-hole 14, through which the body of an opening-ratio controlling screw 16 passes, is formed at the center of the grating.

The shutter fixed plate 26 has an open box shape of a predetermined volume with upwardly extending sides 26*a,* and wing parts 26*b,* each having a predetermined width, extending outwardly from the top of the upwardly extending sides 26*a* on all four rectangular sides. The sides 26*a* have a height of about 1 to 1.5 cm.

A plurality of bolt holes 32 are formed on the wing parts 26*b,* and the wing parts 26*b* are attached to the bottom of the grating 10 by means of clamping bolts 34 with lengths closely corresponding to the height, or thickness, of the grating 10. A plurality of openings 28 are formed in a matrix on the bottom of the shutter fixed plate 26. Four guide projections 30 protrude up from the bottom of the shutter fixed plate 26.

The shutter moving plate 18 is flat and has openings 20 formed thereon. The openings 20 on the moving plate 18 have the same shape and number as those openings 28 on the fixed plate 26. Also, four guide slots 22 are formed on the moving plate 18 corresponding to the guide projections 30 protruding up from the shutter fixed plate 26.

A rack 24 is attached at the center of the upper surface of the moving plate 18 such that its grooves, or teeth, are perpendicular to the moving plate. The rack 24 is aligned parallel to the direction that the moving plate 18 moves. The moving plate fits within the fixed plate 26 and rests on the bottom of the fixed plate 26.

The opening-ratio controlling screw 16 passing through the grating through-hole 14, has a head with either a linear groove or cross grooves, and has a body with longitudinal threads that engage with the rack 24. As the screw 16 is turned, the rack 24 and the attached moving plate 18 move.

In the conventional air flow controlling apparatus, the assembly and operation are as described below.

As illustrated in FIG. 1 and FIG. 2, the shutter fixed plate 26 is bolted to the bottom of the grating 10. The shutter moving plate 18 is placed on the inner bottom of the shutter fixed plate 26 such that the guide projections 30 on the fixed plate 26 fit through the guide slots 22 on the moving plate 18. The moving plate 18 is held in place by its own weight. Then, the opening-ratio controlling screw 16 is inserted into the first through-hole 14 formed on the grating 10 such that its thread engages with the teeth of the rack 24 attached to the moving plate 18.

When the opening-ratio controlling screw 16 is turned, the rack 24 and the attached moving plate 18 moves. At one extreme position of the rack 24, the openings 28 in the fixed plate 26 and the openings 20 in moving plate 18 align, whereby the area of intersection of the two sets of openings is equal to the area of the openings on the fixed plate 26. The ratio of the area of this intersection to the area of the openings on the fixed plate is called the opening ratio. When the openings are aligned as just described, the opening ratio is 100%. At the other extreme position for the rack 24, the openings are fully displaced from each other so that the intersection of the two sets of openings has zero area. In this case the opening ratio is 0%. When the opening ratio is near 100%, the shutter is said to be open; when the opening ratio is near 0%, the shutter is closed.

After the grating with the attached shutter is installed in the floor of the semiconductor clean room, the opening-ratio controlling screw 16 is rotated to control the opening ratio of the shutter so that the air flow in the semiconductor clean room can be properly maintained.

Also installed under the floor of the clean room are structures for supporting the clean room facility, e.g., H-Beams, as well as utility-lines for the facility, various kinds of pumps for circulating the air flow in the semiconductor clean room, blowing fans, ducts and cables, etc. So, when the conventional grating with the attached shutter is being installed in the floor of the clean room, the grating may not fit properly in place because those above-mentioned structures may be in the way. To fit the grating into the correct position, the structures disposed under the floor of the clean room first have to be eliminated, replaced, or shifted.

The problems are a result of the combined height of the shutter fixed plate height and the grating height. Large quantities of time and effort are required for installing and repairing the grating with the attached shutter, which decreases operational capabilities and productivity.

A need exists, therefore, for an apparatus for controlling air flow in a semiconductor clean room that reduces the combined height of the shutter and grating.

SUMMARY OF THE INVENTION

Accordingly, the present invention is directed to an apparatus for controlling air flow in semiconductor clean rooms which substantially overcomes one or more of the problems due to limitations and disadvantages of the related art.

An object of the present invention is to provide an air flow controlling apparatus in which the height of the grating with a shutter attached is reduced to make it easy to install the grating and shutter in a semiconductor clean room. Another object of the present invention is to provide an air flow controlling apparatus in which the grating can be installed easily and the air flow can be controlled easily by adjusting the opening ratio of the shutter.

To achieve these and other advantages and in accordance with the purpose of the invention, as embodied and broadly described, the present invention provides an apparatus for controlling the air flow in semiconductor clean rooms, comprising a grating, having a plurality of air vents, installed horizontally in the semiconductor clean room. The apparatus also includes a shutter comprising a flat shutter fixed plate, having a plurality of first openings, the flat fixed plate being attached to the lower surface of the grating, and a shutter moving plate, having a plurality of second openings corresponding to the first openings, movably disposed between the grating and the flat fixed plate. The apparatus further includes an opening-ratio controller for moving the moving plate with respect to the flat fixed plate whereby an opening ratio defined by the relative positions of the first openings and the second openings is controlled.

In another aspect of the invention, the controller includes a rack attached to the moving plate through a fixed-plate slot in the flat fixed plate. The fixed-plate slot is oriented longitudinally along a movement direction. The controller also includes an opening-ratio controlling screw, having a screw head, a screw body and a screw end. The screw sequentially passes through a grating through-hole formed in the grating, a main slot longitudinally oriented in the moving plate along the movement direction, and a fixed-plate through-hole formed in the flat fixed plate adjacent to the fixed-plate slot but separated from the fixed-plate slot. The screw has a pinion attached to the screw end for engaging the rack.

BRIEF DESCRIPTION OF THE DRAWINGS

The foregoing and other objects, aspects, and advantages of the invention will be described with reference to the accompanying drawings, in which.

DETAILED DESCRIPTION OF THE INVENTION

Figure 1:
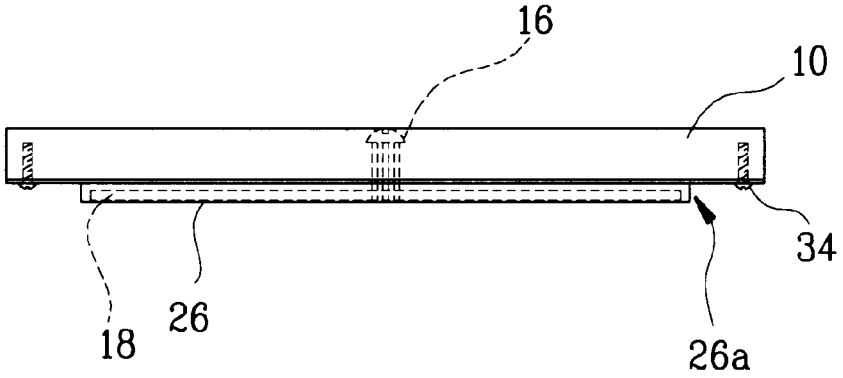
FIG. 1 (PRIOR ART)
FIG. 1 is a side view of a conventional apparatus for controlling air flow in semiconductor clean rooms.

The invention is directed to an apparatus for controlling air flow in a clean room used for semiconductor manufacturing. The apparatus can be used in a clean room where the presence of other equipment below the floor of a clean room prevent the use of a conventional shutter and grating, or in any clean room where there is a need for a reducing the combined height of the shutter and grating.

Reference will now be made in detail to the preferred embodiments of the present invention, examples of which are illustrated in the accompanying drawings. Throughout the drawings and the specification, identical reference numerals denote identical elements.

Figure 3:
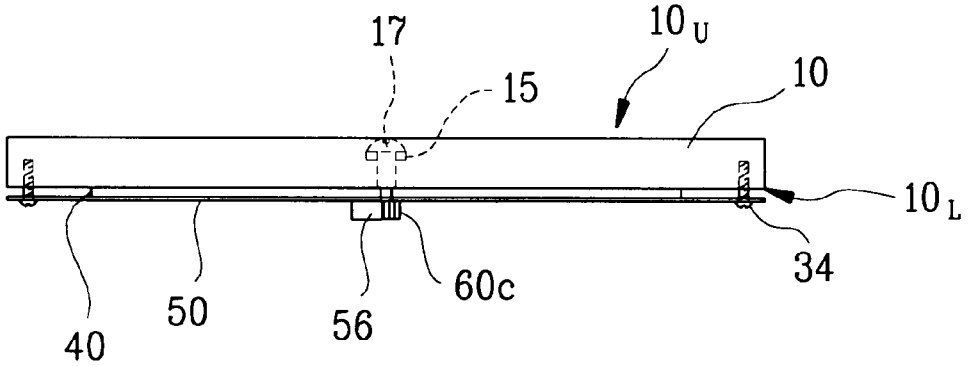
FIG. 3 is a side view of an apparatus for controlling air flow in semiconductor clean rooms according to a preferred embodiment of the present invention.
Figure 4A:
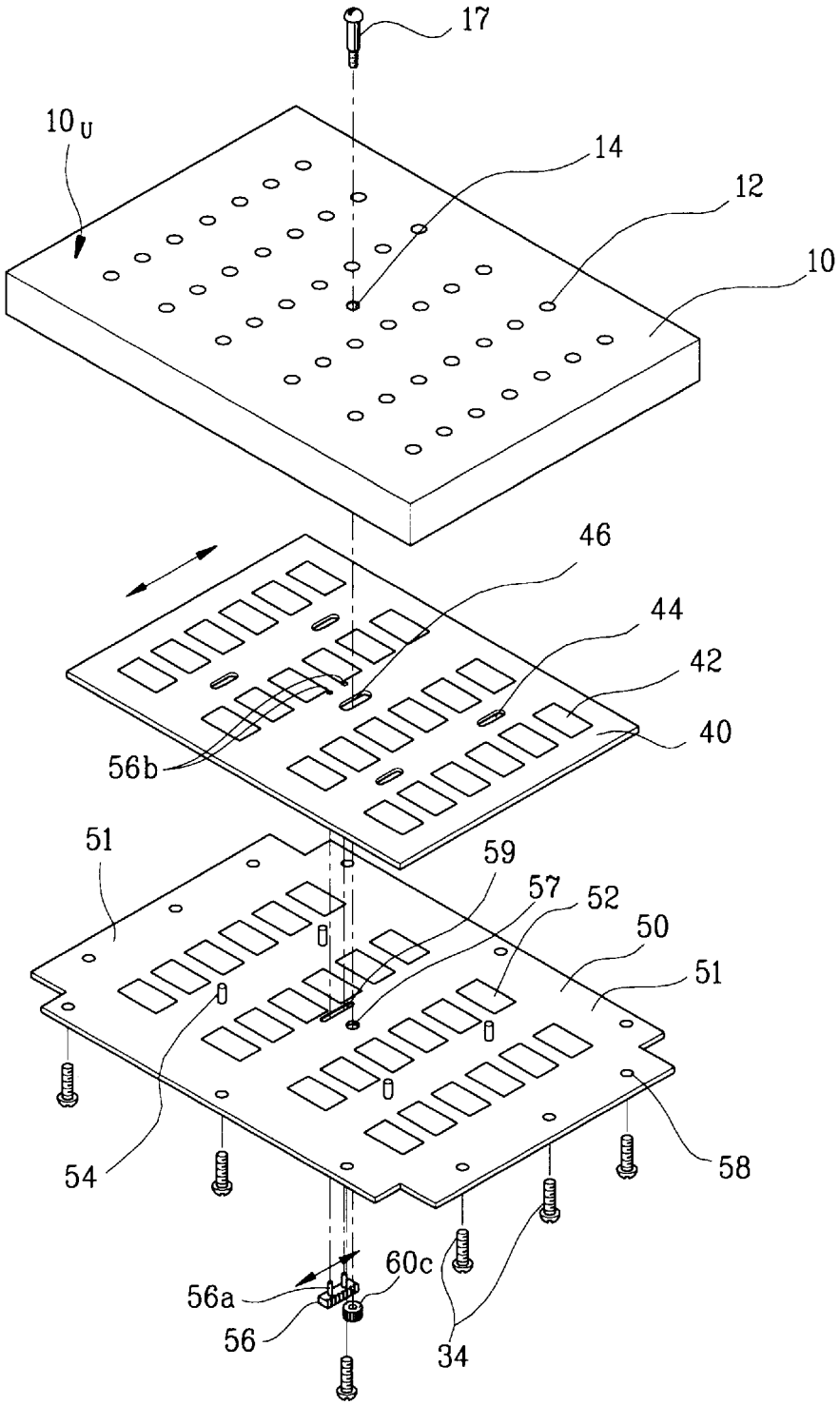
FIG. 4A is an exploded perspective view of the air flow controlling apparatus of FIG. 3.
Figure 4B:
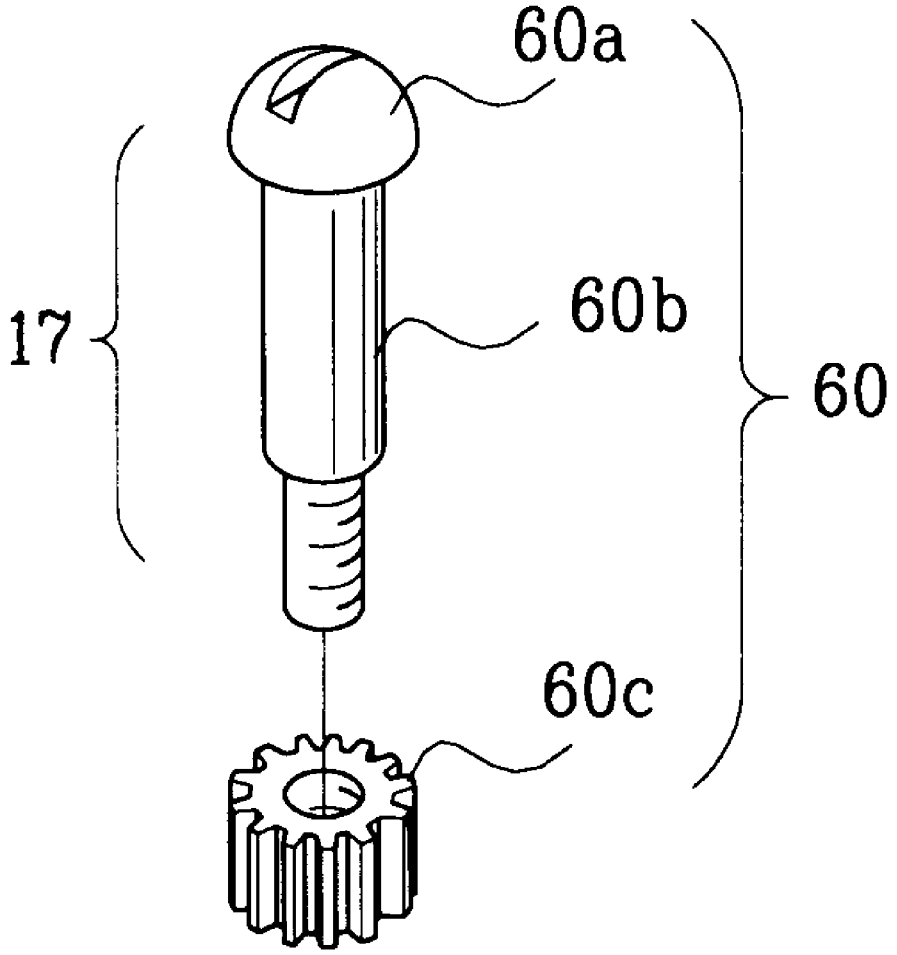
FIG. 4B is an enlarged perspective view of the opening-ratio controlling screw of FIG. 4A.

FIG. 3, FIG. 4A and FIG. 4B illustrate the air flow controlling apparatus according to the present invention. Generally, the present invention includes a box shaped grating 10 having a plurality of air vents 12 and a shutter assembly attached to the lower surface of the grating. The shutter assembly is composed of a shutter fixed plate 50 attached to a lower surface 10L of the grating 10 and a shutter moving plate 40 movably disposed between the grating 10 and the shutter fixed plate 50. However, the shutter assembly of the present invention is dissimilar in shape and operates differently from the conventional devices.

In greater detail, the box shaped grating 10 is formed of a plastic or ceramic material, and has a rectangular upper surface 10U and a given thickness. A plurality of air vents 12 arranged in a matrix for circulating air are formed in the grating 10. A grating through-hole 14, through which a body 60*b* of an opening-ratio controlling screw 60 passes, is formed in the grating 10, at for example, the center of the upper surface 10U as shown in FIG. 4A. As shown in FIG. 3 for the preferred embodiment, the grating through-hole 14 has a stopper 15, such as an O-ring or counter-sunk ledge, for contacting a head 60*a* (see FIG. 4B) of the bolt unit 17 of an opening-ratio controlling screw 60 at a position in the grating through-hole 14 such that the head 60*a* does not project upwardly from the upper surface 10U of the grating 10. Also, the stopper 15 prevents the head 60*a* from passing all the way through the through-hole 14.

Figure 2:
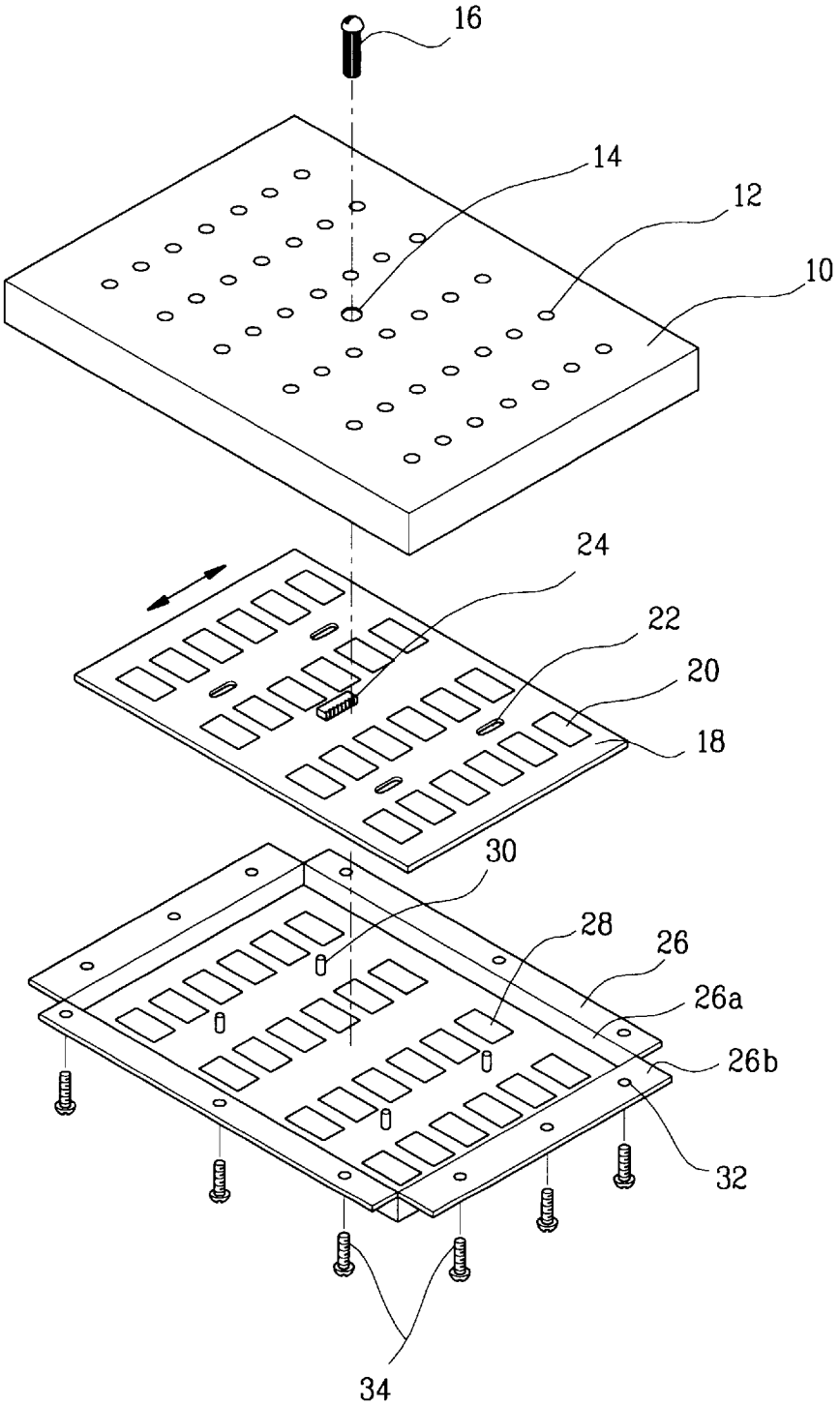
FIG. 2 (PRIOR ART)
FIG. 2 is an exploded perspective view of the air flow controlling apparatus of FIG. 1.

As shown in FIG. 4A, the shutter fixed plate 50 does not have an open box shape like the conventional fixed plate (26 in FIG. 2), but rather has a flat shape. For example, the fixed plate 50 can be in the shape of a flat square or rectangle with wings 51 extending from each side at a predetermined distance. A plurality of bolt holes 58 are formed in the flat shutter fixed plate 50, for example, on the four wings 51, and are clamped to the lower surface 10L of the grating 10 by means of clamping bolts 34. The bolts 34 may have a length corresponding to the thickness of the grating 10, or a length slightly shorter than the thickness of the grating. A plurality of first openings 52 are formed on the flat shutter fixed plate 50 and arranged in a matrix. A plurality of guide projections 54 protrude upwardly from the flat shutter fixed plate 50. For example, there are four projections 54 in the preferred embodiment as shown in FIG. 4A. Also, a fixed-plate through-hole 57, through which the screw body 60*b* passes, is formed at the proper location on flat shutter fixed plate 50. A fixed-plate slot 59 is formed on the flat shutter fixed plate 50 adjacent to the fixed-plate through-hole 57. The longitudinal dimension of the fixed-plate slot 59 is oriented along a direction of movement for the moving plate.

The shutter moving plate 40 is flat like the flat shutter fixed plate 50. A plurality of second openings 42 on the moving plate 40 have the same shape and number as the plurality of first openings 52 on the flat shutter fixed plate 50. Also, guide slots 44 are formed on the shutter moving plate 40 corresponding to the guide projections 54 on the upper surface of the flat shutter fixed plate 50. For example, there are four guide slots in the preferred embodiment as shown in FIG. 4A. The body 60*b* (see FIG. 4B) of the opening-ratio controlling screw 60 must pass through the shutter moving plate 40, so a main slot 46 is formed on the moving plate 40 with the longitudinal dimension oriented in the movement direction of the moving plate 40 relative to the screw body 60*b* as shown by the arrow in FIG. 4A.

A rack 56 is attached to the moving plate 40 through the fixed-plate slot 59 formed on the flat shutter fixed plate 50. The rack 56 may be attached using a variety of means, for example, with projection pins 56*a* intersecting openings 56*b* in the moving plate 40. The teeth of the rack 56 are exposed below the flat shutter fixed plate 50.

As illustrated in FIG. 4B, the opening-ratio controlling screw 60 has a structure in which a bolt unit 17 is assembled with a pinion nut unit 60*c*. A linear or cross groove is formed on the screw head 60*a* of the bolt unit in the opening-ratio controlling screw 60. Screw threads are formed on the end of the screw body 60*b* of the bolt unit 17 to engage the threads of the pinion nut 60*c*. The outer diameter of the pinion 60*c* is greater than the diameter of the fixed-plate through-hole 57, and is assembled by threading the pinion nut 60*c* to the screw body 60*b* from below, after the screw body 60*b* has passed through the fixed-plate through-hole 57.

The assembly and operation of the shutter in the air flow controlling apparatus of the present invention are described below.

The apparatus is assembled as illustrated in FIG. 3. The shutter moving plate 40 is positioned between the flat shutter fixed plate 50 and the grating 10. The flat shutter fixed plate 50 is mounted to the lower surface 10L of the grating 10 using the clamping bolts 34. As shown in FIG. 4A, the moving plate 40 is oriented such that the guide projections 54 protruding up from the upper surface of the flat shutter fixed plate 50 pass through the guide slots 44 in the moving plate 40. Then, the bolt unit 17 of the opening-ratio controlling screw 60 (FIG. 4B) is inserted into the grating through-hole 14 (FIG. 4A) from the top, and the pinion 60*c* is threaded onto the screw body 60*b* (FIG. 4B) protruding below the flat shutter fixed plate 50.

After being installed in the floor of the clean room, the apparatus is operated as described with reference to FIG. 4A and FIG. 4B. The opening-ratio controlling screw 60 is rotated back and forth in the direction of the arrow by a screw driver engaged in the grooves on the screw head 60*a*. The pinion 60*c*, engaged with the rack 56, rotates correspondingly so that the rack 56, and the moving plate 40 attached to the rack 56, move back and forth. Therefore, the shutter moving plate 40 moves in relation to the flat shutter fixed plate 50. The opening ratio of the shutter varies in accordance with the relative positions of the first openings 52 and the second openings 42. As a result, the proper air flow can be maintained in the semiconductor clean room by the correct opening ratio obtained by adjusting the opening-ratio controlling screw 60.

The present invention is not limited to the specific preferred embodiments described by the above examples, but can be modified or varied and remain within the scope of the present invention. For example, the shape or type of material used for the grating 10 can be changed. Also, the shape of the shutter can be changed corresponding to the change in the grating. Further, the shape of the openings 52 and 42 respectively formed on the flat shutter fixed plate 50 and the shutter moving plate 40 can be changed from the rectangular shape in the drawings to other straight sided or curved shapes.

The opening ratio control feature of the present invention can be attained by the disclosed movement of the shutter moving plate 40 from side to side, as well as by rotating the shutter moving plate 40 about its central axis. In this case the main slot 46 and the guide slots 44 in the moving plate 40, and the fixed-plate slot 59 in the flat shutter fixed plate 50 will be curved rather than straight as shown in the drawings. Also, the opening-ratio controlling screw 60 and the rack 56 can be displaced from the center of the grating 10, the flat shutter fixed plate 50, and the moving plate 40.

In the preferred embodiment, when the rack 56 is moved to one end of the fixed-plate slot 59, the first and second openings 52 and 42 align with each other so that the shutter is open, i.e., the opening ratio is 100%. When the rack 56 is moved to the other end of the fixed-plate slot 59, in the preferred embodiment, the first and second openings 52 and 42 deviate completely from each other so that the shutter is closed, i.e., the opening ratio is 0%. Of course, the opening ratio may be controlled in any intermediate range as well.

In addition, adequate sealing between the grating and the flat shutter fixed plate can be accomplished in a number of ways, none of which is preferred. For example, the bottom of the grating and the edge of the flat shutter fixed plate can be sealed. Also, the flat shutter fixed plate 50 can be curved at portions of the flat shutter fixed plate 50 outside the range of movement of the shutter moving plate 40, whereby the outer edge of the flat shutter fixed plate contacts the outer lower edge of the grating.

Therefore, according to the present invention, a grating and shutter can be installed easily in the floor of a semiconductor clean room even though supporting structures, utility lines, various kinds of pumps for circulating the air, blowing fans, or duct lines occupy the space below the floor of the semiconductor clean room. Therefore, these structures do not have to be eliminated, replaced, or shifted to install the apparatus of the present invention. Thus, operational efficiency and productivity can be improved to a large extent.

It will be apparent to those skilled in the art that various other modifications and variations can be made in the apparatus for controlling the air flow in the semiconductor clean rooms of the present invention without departing from the spirit or scope of the invention. Thus, it is intended that the present invention cover the modifications and variations of this invention provided they come within the scope of the appended claims and their equivalents.

What is claimed is:

1. An apparatus for controlling air flow, comprising:

a grating having a plurality of air vents;

a shutter assembly comprising a shutter fixed plate, having a plurality of first openings, the fixed plate being attached to a lower surface of the grating, and a shutter moving plate, having a plurality of second openings corresponding to the first openings, movably disposed between the grating and the fixed plate; and an opening-ratio controller for moving the moving plate with respect to the fixed plate whereby an opening ratio defined by relative positions of the first openings and the second openings is controlled, the opening-ratio controller comprising a rack, attached to the moving plate through a fixed-plate slot in the fixed plate, the fixed-plate slot longitudinally oriented along a movement direction; and an opening-ratio controlling screw, having a screw head, a screw body and a screw end, sequentially passing through a grating through-hole formed in the grating, a main slot longitudinally oriented in the moving plate along the movement direction, and a fixed-plate through-hole formed in the fixed plate adjacent to the fixed-plate slot but separated from the fixed-plate slot, and having a pinion attached to the screw end for engaging the rack.

2. The apparatus of claim 1, wherein the pinion is attached to the screw end below the fixed plate.

3. The apparatus of claim 2, wherein an outer diameter of the pinion is larger than a diameter of the fixed-plate through-hole whereby the pinion can not pass through the fixed-plate through-hole.

4. The apparatus of claim 1, wherein the grating through-hole has a stopping means wherein a top of the screw head does not project upwardly from an upper surface of the grating, and wherein the screw head can not pass below the stopping means.

5. The apparatus of claim 1, wherein the first openings are arranged in a rectangular matrix and the second openings are arranged in the same rectangular matrix.

6. The apparatus of claim 5, wherein, when the rack is positioned at one end of the fixed-plate slot, the first openings are aligned with the second openings so that the shutter is open; and when the rack is positioned at another end of the fixed-plate slot, the first openings are displaced from the second openings so that the shutter is closed.

7. The apparatus of claim 1, the fixed plate further comprising a plurality of guide projections which pass through a plurality of corresponding guide slots on the moving plate to guide the movement of the moving plate.

8. The apparatus of claim 7, wherein the guide slots are longitudinally oriented along the movement direction, and a length of each guide slot is substantially equal to a length of the fixed-plate slot.

* * * * *